US005823888A

United States Patent [19]

Maruko et al.

[11] Patent Number: 5,823,888

[45] Date of Patent: Oct. 20, 1998

[54] WOUND GOLF BALL

[75] Inventors: Takashi Maruko; Junji Umezawa, both of Chichibu, Japan

[73] Assignee: Bridgestone Sports Co., Ltd., Tokyo, Japan

[21] Appl. No.: 852,947

[22] Filed: May 8, 1997

[30] Foreign Application Priority Data

May 10, 1996 [JP] Japan ..... 8-141035

[51] Int. Cl.[6] ..... A63B 37/08; A63B 37/06; A63B 37/12; A63B 37/14

[52] U.S. Cl. ..... 473/354; 473/365; 473/384; 273/DIG. 20

[58] Field of Search ..... 473/354, 357, 473/365, 384

[56] References Cited

U.S. PATENT DOCUMENTS 5,497,996 3/1996 Cadorniga ..... 473/365
5,601,503 2/1997 Yamagishi et al. ..... 473/351 X
5,702,312 12/1997 Horiuchi et al. ..... 473/351 X
5,704,853 1/1998 Maruko et al. ..... 473/363

*Primary Examiner*—George J. Marlo
*Attorney, Agent, or Firm*—Sughrue, Mion, Zinn, Macpeak & Seas, PLLC

[57] ABSTRACT

A wound golf ball comprising a center, a thread rubber layer and a cover has a weight of 40–45 grams and a distortion of 2.6–3.6 mm under a load of 100 kg. The center has an outer diameter of 30–35 mm and a distortion of 1.6–4 mm under a load of 30 kg. The cover has a Shore D hardness Hd of 50–68 and a gage of 1.2–2.2 mm. A percent overall dimple volume Vr which is defined as the sum of the volumes of dimple spaces each below a circular plane circumscribed by the dimple edge divided by the volume of the ball satisfies: $(0.985-0.002\ Hd) \leqq Vr \leqq (1.085-0.002\ Hd)$. The ball launches at a greater launch angle and initial velocity upon driver full shots at low head speed, traveling a longer distance.

15 Claims, 1 Drawing Sheet

WOUND GOLF BALL

BACKGROUND OF THE INVENTION

1. Field of the Invention This invention relates to a wound golf ball suitable for use by low club head speed players.

2. Prior Art

Traditionally, wound golf balls are manufactured by winding high extensibility thread rubber around a liquid or solid center to form a thread rubber layer on the center and enclosing the thread rubber layer with a cover of balata rubber or ionomer resin.

Professional and low-handicap golfers prefer wound golf balls because the wound golf balls are soft in hitting feel and superior in spin rate (or spin receptivity) as compared with two-piece solid golf balls. With respect to flight distance, however, the wound golf balls are inferior to the two-piece solid golf balls.

Various attempts were made to increase the flight distance of wound golf balls. Most wound golf balls target golfers who swing at high head speeds in excess of 45 m/sec., that is, average to advanced players. Thus players who swing at high head speeds can take the advantage of increased flight distance. However, when players who swing at low head speeds, such as a beginner, female and senior use the same golf balls, they can not always obtain the advantage of increased flight distance. This is because a weaker force applied to the ball upon impact causes less deformation of the ball and the flight distance becomes more dependent on the club head speed.

Usually, slow club head speed players choose lightweight and soft balls. Since these balls, however, are not originally designed optimum for slow head speed players, the balls follow a low trajectory rather than a high trajectory, failing to extend the flight distance.

Also the aerodynamics of a golf ball are largely affected by dimple parameters including the shape, type, size, volume, arrangement and number of dimples. The flight performance can be improved by optimizing dimple parameters because an appropriate dimple effect cooperates with the rotation or spin rate of the ball such that the ball may gain a more lift and receive a less air resistance.

However, there is room to further optimize dimple parameters, especially for low head speed players.

As the number of golf players, especially female and senior players increases in these years, the demand for golf balls with respect to their playability factors is diversified to meet the level of individual players. It is desired to have a wound golf ball adequate for low head speed players.

Therefore, an object of the invention is to provide a novel and improved wound golf ball which provides a greater launch angle and initial velocity to travel a longer distance upon driver full shots even at low club head speed, and is thus suitable for beginner, female and senior players who swing at low club head speeds.

SUMMARY OF THE INVENTION

In connection with a wound golf ball comprising a center, a thread rubber layer and a cover, we have found that the ball is increased in launch or initial velocity and tends to rise higher when the ball has a light weight of 40 to 45 grams and a hardness corresponding to a distortion of 2.6 to 3.6 mm under a load of 100 kg. When the center has a larger outer diameter of 30 to 35 mm and a hardness corresponding to a distortion of 1.6 to 4 mm under a load of 30 kg and the cover has a Shore D hardness of 50 to 68 and a gage of 1.2 to 2.2 mm, the ball is improved in restitution and launch angle so that a player with a low club head speed of less than 40 m/sec., especially less than 38 m/sec. can enjoy an increased flight distance upon full shot with a driver. When dimples are formed such that a percent overall dimple volume Vr which is given by the formula:

$$Vr = \frac{Vs}{\frac{4}{3}\pi R^3} \times 100 \quad (1)$$

wherein Vs is a sum of the volumes of dimple spaces each below a circular plane circumscribed by the dimple edge and R is a radius of the ball satisfies:

$$0.985-0.002Hd \leqq Vr \leqq 1.085-0.002Hd \quad (2)$$

wherein Hd is the Shore D hardness of the cover, dimple parameters are optimized to further improve the flight performance of the ball. The synergistic effect of these factors provides a wound golf ball with improved performance and quality best suited for low head speed players, especially beginner, female and senior players.

Accordingly, the present invention provides a wound golf ball comprising a wound core consisting essentially of a center and a thread rubber layer thereon and a cover enclosing the wound core, wherein the ball has a weight of 40 to 45 grams and a hardness corresponding to a distortion of 2.6 to 3.6 mm under a load of 100 kg, the center has an outer diameter of 30 to 35 mm and a hardness corresponding to a distortion of 1.6 to 4 mm under a load of 30 kg, the cover has a Shore D hardness of 50 to 68 and a gage of 1.2 to 2.2 mm, and a percent overall dimple volume Vr which is given by the formula (1) satisfies:

$$0.985-0.002Hd \leqq Vr \leqq 1.085-0.002Hd \quad (2)$$

wherein Hd is the Shore D hardness of the cover.

BRIEF DESCRIPTION OF THE DRAWINGS

These and further features of the present invention will be apparent with reference to the following description and drawings, wherein.

DETAILED DESCRIPTION OF THE INVENTION

Figure 1:
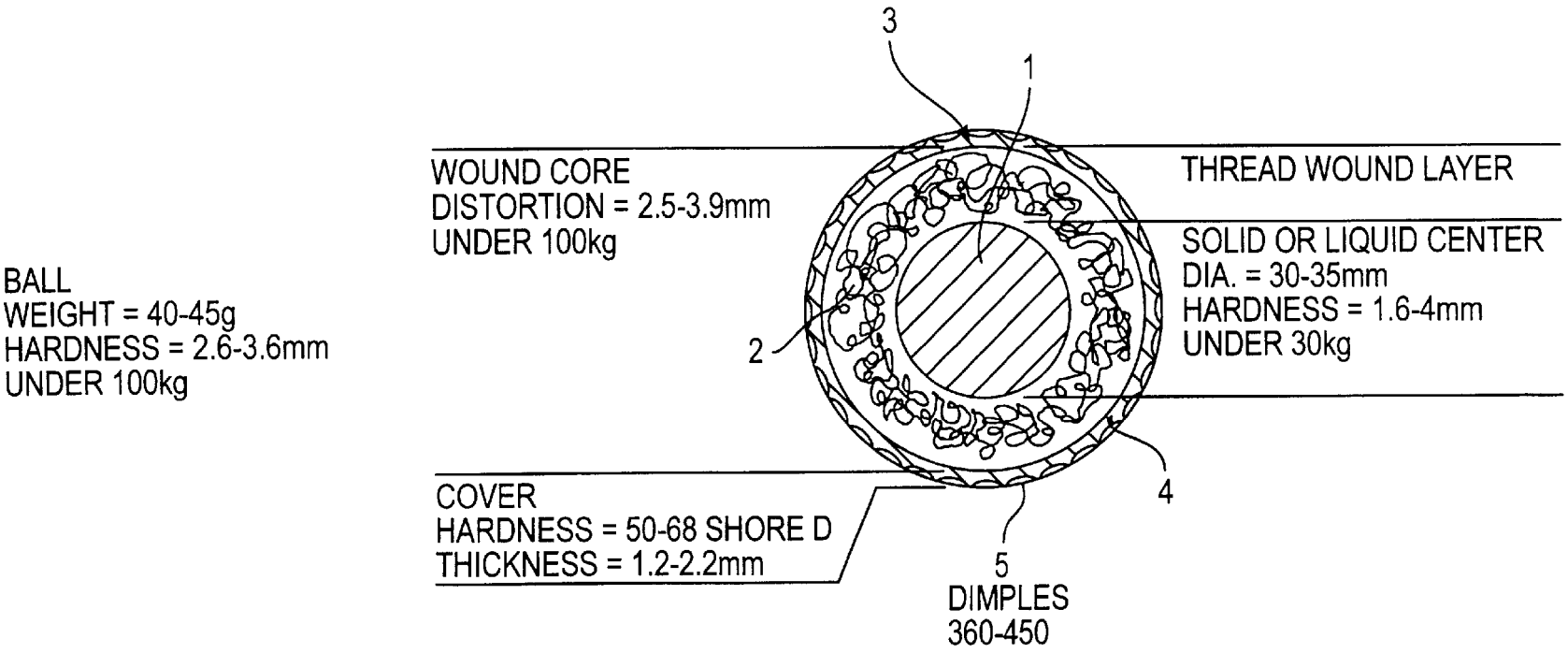
FIG. 1 is a schematic cross-sectional view of a wound golf ball according to one embodiment of the invention.

Referring to FIG. 1, the wound golf ball of the present invention includes a wound core 3 consisting essentially of a center 1 and a thread rubber layer 2 thereon. The wound core 3 is enclosed with a cover 4.

The wound golf ball of the invention should have a weight of 40 to 45 grams, preferably 41 to 44.8 grams, more preferably 42.5 to 44.5 grams. Balls having a weight of less than 40 grams are aerodynamically affected by the wind during flight and fail to cover a long distance because back spin creates a lift to loft the ball and the inertia force is too small. Balls having a weight of more than 45 grams have no significant difference from conventional wound golf balls and cannot exert their performance upon low head speed hitting. In addition, the ball should have a hardness corresponding to a distortion of 2.6 to 3.6 mm, preferably 2.8 to 3.4 mm under a load of 100 kg. A distortion of less than 2.6 mm indicates that the ball is so hard that the ball might not be fully deformed upon low head speed shots, resulting in shortage of flight distance. A distortion of more than 3.6 mm indicates that the ball is soft and less resilient and would fail to travel a distance. The diameter of the ball is not critical although it is generally 42.67 mm or more, preferably 42.67 to 42.8 mm.

The center 1 may be either a solid center or a liquid center. The solid center is preferred because of greater resilience and a possible increase of flight distance. The center should have an outer diameter of 30 to 35 mm, preferably 31 to 34 mm. A center diameter of less than 30 mm would fail to increase the launch angle and flight distance whereas a center diameter of more than 35 mm requires the wound rubber layer to be thin, resulting in a loss of durability. The center should also have a hardness corresponding to a distortion of 1.6 to 4 mm, preferably 1.8 to 3.8 mm under a load of 30 kg. A distortion of less than 1.6 mm means that the center is too hard to reduce a spin rate. A distortion of more than 4 mm means that the center is so soft that the center might be deformed upon winding of thread rubber, leaving a likelihood that an increased tension of thread rubber can detract from durability.

The solid center should preferably have a rebound height of 96 to 105 cm when dropped under gravity on a rigid surface from a height of 120 cm.

The center may be prepared from well-known materials by conventional methods. For example, a solid center is prepared by conventional methods from a composition comprising cis-1,4-polybutadiene as a base elastomer and well-known additives.

The thread rubber layer 2 is formed by winding thread rubber around the center 1 under high tension. The weight and thickness of the thread rubber layer 2 are not critical and may be properly selected. The winding of thread rubber is done by conventional methods while thread rubber of well-known composition may be used. The specific gravity and size of thread rubber can be properly selected as long as the objects of the invention are achievable. Typically thread rubber has a width of 1.3 to 2.0 mm and a thickness of 0.3 to 0.6 mm in cross section.

The wound core 3 consisting essentially of the center 1 and the thread rubber layer 2 should preferably have a hardness corresponding to a distortion of 2.5 to 3.9 mm under a load of 100 kg. More preferably, the hardness of the wound core divided by the hardness of the ball (both expressed by a distortion under a load of 100 kg) ranges from 0.9 to 1.1. The wound core usually has a diameter of 39 to 41 mm, especially 39.5 to 40.5 mm though not critical.

Next, the wound core 3 is enclosed with the cover 4. The cover should have a gage (radial thickness) of 1.2 to 2.2 mm, preferably 1.4 to 2.0 mm. A cover with a gage of less than 1.2 mm would be less durable when topped. A cover with a gage of more than 2.2 mm would detract from restitution and hitting feel. The cover should also have a Shore D hardness of 50 to 68, preferably 53 to 65. A cover hardness of less than 50 in Shore D leads to a more spin rate so that the ball might loft and travel short. A material providing a Shore D hardness of more than 68 would be brittle and less durable.

The cover 4 may be formed of any desired cover stock. Conventional cover stocks, typically ionomer resins are useful. Illustrative examples include ionomer resins such as Himilan 1605, 1706 and 1557 (trade name, manufactured by Mitsui-duPont Polychemical K. K.) and Surlyn 8120 (trade name, manufactured by E. I. duPont). They may be used alone or in admixture of two or more.

The wound core 3 can be enclosed with the cover 4 by methods used with conventional ionomer resin covers, for example, by directly injection molding a cover stock over the core or by preforming a pair of hemispherical half cups from a cover stock, encasing the core with the half cups and effecting heat compression molding at 140° to 180° C. for 2 to 10 minutes.

Like conventional golf balls, the wound golf ball of the invention is formed in its cover surface with a multiplicity of dimples 5 by a well-known method. According to the invention, dimples are designed such that a percent overall dimple volume Vr which is given by the formula:

$$Vr = \frac{Vs}{\frac{4}{3}\pi R^3} \times 100 \quad (1)$$

wherein Vs is a sum of the volumes of dimple spaces each below a circular plane circumscribed by the dimple edge and R is a radius of the ball satisfies:

$$0.985-0.002Hd \leqq Vr \leqq 1.085-0.002Hd \quad (2)$$

wherein Hd is the Shore D hardness of the cover. As long as the percent overall dimple volume Vr falls within the range that is determined by expression (2) relative to the Shore D hardness of the cover, there are obtained optimum dimples for a particular cover hardness. With Vr outside the range of expression (2), the ball would deviate from an optimum trajectory and travel short.

In a further preferred embodiment of the invention, a percent dimple surface area occupation Sr is adjusted to 65 to 82%, especially 70 to 80%. The percent dimple surface area occupation Sr is a percent of the sum (Sd) of surface areas of phantom planes circumscribed by the dimple edge relative to the surface area (Sb) of a phantom sphere given on the assumption that the golf ball has no dimples on its spherical surface, that is, Sr=Sd/Sb×100%. When the percent dimple surface area occupation Sr falls within the above-defined range, the dimples cover a greater area than the golf ball spherical surface (land area), which leads to an improvement in lift.

By adjusting the percent overall dimple volume Vr and the percent dimple surface area occupation Sr to fall within the above-defined ranges, the dimple design is optimized, allowing the above-mentioned ball construction to exert the flight distance increasing effect more efficiently. The ball is thus best suited for low club head speed players.

It is noted that the number of dimples 5 varies from 360 to 450, preferably from 372 to 432. Often, two or more types of dimples which are different in diameter, depth and other parameters are formed. Preferably dimples have a diameter of 2.2 to 4.3 mm and a depth of 0.1 to 0.24 mm. The arrangement of dimples is not critical although well-known arrangements including regular octahedral, dodecahedral and icosahedral arrangements may be used. The pattern formed on the ball surface by such a dimple arrangement may be any of square, hexagon, pentagon, and triangle patterns.

The wound golf ball of the invention is best suited for golfers who swing at a low club head speed. The term "low club head speed" means a head speed of less than about 35 m/sec. when a driver (#W1) is used as a club. Therefore, the wound golf ball of the invention is best suited for golfers with a low head speed of about 35 m/sec.

With respect to the weight, size, symmetry and initial velocity, the golf ball of the invention should, of course, comply with the Rules of Golf. The ball has a diameter of not less than 42.67 mm and an initial velocity of not greater than 76.2 m/sec. when measured on apparatus approved by the R & A (prescribing a maximum tolerance of 2%, that is, 77.7 m/sec. and a ball temperature of 23°±1° C. when tested).

Because the reduced ball weight and optimized dimple parameters, the wound golf ball of the invention launches at a greater launch angle and initial velocity upon driver full shots even at low head speed. A longer flight distance is ensured. The wound golf ball is thus suitable for beginner, female and senior players who swing at low head speeds.

EXAMPLE

Examples of the present invention are given below by way of illustration and not by way of limitation. All parts are by weight.

Examples 1–6 & Comparative Examples 1–7

Nine solid centers were prepared by milling components of a center-forming composition as shown in Table 1 and molding and vulcanizing the composition in a mold at 160° C. for 15 minutes.

TABLE 1

| Type | | Center 1 | 2 | 3 | 4 | 5 | 6 | 7 | 8 | 9 |
|---|---|---|---|---|---|---|---|---|---|---|
| Composition (pbw) | Polybutadiene rubber | 100 | 100 | 100 | 100 | 100 | 100 | 100 | 100 | 100 |
| | Zinc acrylate | 15 | 15 | 15 | 20 | 20 | 20 | 15 | 15 | 20 |
| | Zinc oxide | 5 | 5 | 5 | 5 | 5 | 5 | 5 | 5 | 5 |
| | Barium sulfate | 40 | 34 | 14 | 35 | 30 | 10 | 64 | 78 | 59 |
| | Aroma oil | 8 | 8 | 8 | 0 | 0 | 0 | 8 | 8 | 0 |
| | Dicumyl peroxide | 1.2 | 1.2 | 1.2 | 1.2 | 1.2 | 1.2 | 1.2 | 1.2 | 1.2 |
| Outer diameter (mm) | | 31.8 | 31.8 | 31.8 | 31.8 | 31.8 | 31.8 | 31.8 | 27.8 | 31.8 |
| Weight (g) | | 21.4 | 20.9 | 18.9 | 21.4 | 20.9 | 18.9 | 23.6 | 16.1 | 23.6 |
| Hardness* (mm) | | 3.7 | 3.7 | 3.7 | 1.9 | 1.9 | 1.9 | 3.7 | 3.7 | 1.9 |

*distortion (mm) under a load of 30 kg

Thread rubber of the following composition and size was wound around the solid center by a conventional method, producing a wound core.

Thread rubber composition and size

| Thread rubber composition and size | |
|---|---|
| Polyisoprene rubber | 70 parts |
| Natural rubber | 30 parts |
| Zinc oxide | 1.5 parts |
| Stearic acid | 1 parts |
| Vulcanization accelerator + sulfur | 2.6 parts |
| Specific gravity | 0.93 |
| Width | 1.6 mm |
| Thickness | 0.55 mm |

A pair of hemispherical half cups were prepared by milling components as shown in Table 2 to form a cover stock and molding the cover stock into half cups.

TABLE 2

| Type | Cover I | II |
|---|---|---|
| Himilan 1605 | — | 50 parts |
| Himilan 1706 | — | 50 parts |
| Himilan 1557 | 60 parts | — |
| Surlyn 8120 | 40 parts | — |
| Shore D hardness | 53 | 65 |

Himilan 1605, 1706 and 1557 are ionomer resins manufactured by Mitsui-duPont Polychemical K. K. and Surlyn 8120 is an ionomer resin manufactured by E. I. duPont.

Wound golf balls of Examples 1 to 6 and Comparative Examples 1 to 7 were prepared by enclosing the wound core with a pair of half cups in a combination as shown in Tables 3 and 4 and effecting heat compression molding at 140° C. and 120 kg/cm$^2$. The balls thus formed had dimples in their surface as shown in Tables 3 and 4. It is noted that the preferred range of the percent overall dimple volume Vr calculated from the Shore D hardness of covers I and II is in the range: $0.879 \leqq Vr \leqq 0.979$ for cover I with a Shore D hardness of 53 and $0.855 \leqq Vr \leqq 0.955$ for cover II with a Shore D hardness of 65.

The balls were examined by the following test. The results are shown in Tables 3 and 4.

Hardness

A load of 100 kg was applied to the ball or the wound core to measure a distortion (mm).

Hitting Test

Using a swing robot, the ball was hit with No. 1 wood (driver) at a heat speed of 35 m/sec. (HS35) to measure a spin rate, launch angle, elevation angle, carry and total distance.

TABLE 3

| Example | | 1 | 2 | 3 | 4 | 5 | 6 |
|---|---|---|---|---|---|---|---|
| Center | Type | 1 | 2 | 3 | 4 | 5 | 6 |
| | Outer diameter (mm) | 31.8 | 31.8 | 31.8 | 31.8 | 31.8 | 31.8 |
| | Weight (g) | 22.4 | 21.9 | 19.9 | 22.4 | 21.9 | 19.9 |
| | Hardness (mm) | 3.7 | 3.7 | 3.7 | 1.9 | 1.9 | 1.9 |
| Wound core | Outer diameter (mm) | 40.0 | 40.0 | 40.0 | 40.0 | 40.0 | 40.0 |
| | Weight (g) | 34.8 | 34.3 | 32.3 | 34.8 | 34.3 | 32.3 |
| | Hardness (mm) | 2.9 | 2.9 | 2.9 | 3.2 | 3.2 | 3.2 |

TABLE 3-continued

| Example | | 1 | 2 | 3 | 4 | 5 | 6 |
|---|---|---|---|---|---|---|---|
| Ball | Outer diameter (mm) | 42.7 | 42.7 | 42.7 | 42.7 | 42.7 | 42.7 |
| | Weight (g) | 44.0 | 43.5 | 41.5 | 44.0 | 43.5 | 41.5 |
| | Hardness (mm) | 3.0 | 3.0 | 3.0 | 3.0 | 3.0 | 3.0 |
| Wound core hardness/ball hardness | | 0.96 | 0.96 | 0.96 | 1.07 | 1.07 | 1.07 |
| Cover | Type | I | I | I | II | II | II |
| | Shore D hardness | 53 | 53 | 53 | 65 | 65 | 65 |
| Dimple | Number | 396 | 396 | 396 | 372 | 372 | 372 |
| | Vr | 0.925 | 0.925 | 0.925 | 0.900 | 0.900 | 0.900 |
| HS35/#W1 | Spin (rpm) | 4310 | 4250 | 4190 | 4070 | 4030 | 3960 |
| | Launch angle (°) | 12.1 | 12.3 | 12.4 | 12.4 | 12.5 | 12.6 |
| | Carry (m) | 144.1 | 145.3 | 145.5 | 144.5 | 145.5 | 145.9 |
| | Total (m) | 155.7 | 156.2 | 155.4 | 157.3 | 158.1 | 157.6 |
| | Elevation angle (°) | 12.6 | 12.8 | 13.2 | 12.5 | 12.7 | 13.0 |

TABLE 4

| Comparative Example | | 1 | 2 | 3 | 4 | 5 | 6 | 7 |
|---|---|---|---|---|---|---|---|---|
| Center | Type | 7 | 2 | 2 | 8 | 9 | 5 | 5 |
| | Outer diameter (mm) | 31.8 | 31.8 | 31.8 | 27.8 | 31.8 | 31.8 | 31.8 |
| | Weight (g) | 23.6 | 21.9 | 21.9 | 16.1 | 23.6 | 21.9 | 21.9 |
| | Hardness (mm) | 3.7 | 3.7 | 3.7 | 3.7 | 1.9 | 1.9 | 1.9 |
| Wound core | Outer diameter (mm) | 40.0 | 40.0 | 40.0 | 40.0 | 40.0 | 40.0 | 40.0 |
| | Weight (g) | 36.0 | 34.3 | 34.3 | 34.3 | 36.0 | 34.3 | 34.3 |
| | Hardness (mm) | 2.9 | 2.9 | 2.9 | 2.9 | 3.2 | 3.2 | 3.2 |
| Ball | Outer diameter (mm) | 42.7 | 42.7 | 42.7 | 42.7 | 42.7 | 42.7 | 42.7 |
| | Weight (g) | 45.2 | 43.5 | 43.5 | 43.5 | 45.2 | 43.5 | 43.5 |
| | Hardness (mm) | 3.0 | 3.0 | 3.0 | 3.0 | 3.0 | 3.0 | 3.0 |
| Wound core hardness/ball hardness | | 0.96 | 0.96 | 0.96 | 0.96 | 1.07 | 1.07 | 1.07 |
| Cover | Type | I | I | I | I | II | II | II |
| | Shore D hardness | 53 | 53 | 53 | 53 | 65 | 65 | 65 |
| Dimple | Number | 396 | 396 | 396 | 396 | 372 | 372 | 372 |
| | Vr | 0.925 | 0.850 | 1.000 | 0.925 | 0.900 | 0.825 | 0.975 |
| HS35/#W1 | Spin (rpm) | 4400 | 4430 | 4380 | 4650 | 4180 | 4200 | 4190 |
| | Launch angle (°) | 12.0 | 12.0 | 12.0 | 11.8 | 12.4 | 12.4 | 12.4 |
| | Carry (m) | 143.0 | 141.8 | 140.8 | 144.4 | 143.6 | 140.0 | 138.5 |
| | Total (m) | 154.0 | 151.7 | 153.7 | 153.6 | 155.7 | 150.9 | 152.2 |
| | Elevation angle (°) | 12.6 | 13.5 | 11.8 | 12.7 | 12.4 | 13.3 | 11.5 |

It is evident from Tables 3 and 4 that upon full shots by a driver at a low club head speed of 35 m/sec., golf balls of Comparative Examples fail to travel a satisfactory distance because of a heavy weight in Comparative Examples 1 and 5, an inappropriate overall dimple volume Vr in Comparative Examples 2, 3, 6 and 7, and a small center diameter in Comparative Example 4. In contrast, wound golf balls within the scope of the invention (Examples 1 to 6) gain a greater launch angle upon full shots by a driver at a low head speed and thus travel a longer distance.

Although some preferred embodiments have been described, many modifications and variations may be made thereto in the light of the above teachings. It is therefore to be understood that within the scope of the appended claims, the invention may be practiced otherwise than as specifically described.

We claim:

1. A wound golf ball comprising a wound core consisting essentially of a center and a thread rubber layer thereon and a cover enclosing the wound core, wherein said ball has a weight of 40 to 45 grams and a hardness corresponding to a distortion of 2.6 to 3.6 mm under a load of 100 kg, said center has an outer diameter of 30 to 35 mm and a hardness corresponding to a distortion of 1.6 to 4 mm under a load of 30 kg, said cover has a Shore D hardness of 50 to 68 and a gage of 1.2 to 2.2 mm, and a percent overall dimple volume Vr which is given by the formula:

$$Vr = \frac{Vs}{\frac{4}{3}\pi R^3} \times 100 \quad (1)$$

wherein Vs is a sum of the volumes of dimple spaces each below a circular plane circumscribed by the dimple edge and R is a radius of the ball satisfies:

$$0.985-0.002Hd \leqq Vr \leqq 1.085-0.002Hd \quad (2)$$

wherein Hd is the Shore D hardness of said cover.

2. The wound golf ball of claim 1 wherein said center is a solid center.

3. The wound golf ball of claim 1 wherein said center is a liquid center.

4. The wound golf ball of claim 1 wherein said ball has a weight in the range of 41 to 44.8 g.

5. The wound golf ball of claim 4 wherein said ball has a weight in the range of 42.5 to 44.5 g.

6. The wound golf ball of claim 1 wherein said center has an outer diameter in the range of 31 to 345 mm.

7. The wound golf ball of claim 1 wherein said center has a hardness corresponding to a distortion in the range of 1.8 to 3.8 mm under a load of 100 kg.

8. The wound golf ball of claim 1 wherein said cover has a Shore D hardness in the range of 53 to 65.

9. The wound golf ball of claim 1 wherein a percent dimple surface area occupation is in the range of 65 to 82%.

10. The wound golf ball of claim 9 wherein said percent dimple surface area occupation is in the range of 70 to 80%.

11. The wound golf ball of claim 9 wherein said dimples have a diameter in the range of 2.2 to 4.3 mm and a depth in the range of 0.1 to 0.24 mm.

12. The wound golf ball of claim 9 wherein the number of dimples is in the range of 360 to 450.

13. The wound golf ball of claim 1 wherein said ball is a diameter in the range of 52.67 to 42.8 mm.

14. The wound golf ball of claim 1 wherein said wound core including said thread rubber layer has a diameter in the range of 39 to 41 mm.

15. The wound golf ball of claim 1 wherein said cover has a gauge in the range of 1.4 to 2.0 mm.

* * * * *